US008727552B2

(12) United States Patent
Heise

(10) Patent No.: US 8,727,552 B2
(45) Date of Patent: May 20, 2014

(54) SPOTLIGHT WITH DIFFUSER

(76) Inventor: Sebastian Heise, Kastorf (DE)

( * ) Notice: Subject to any disclaimer, the term of this patent is extended or adjusted under 35 U.S.C. 154(b) by 534 days.

(21) Appl. No.: 12/964,493

(22) Filed: Dec. 9, 2010

(65) Prior Publication Data

US 2011/0170296 A1 Jul. 14, 2011

(30) Foreign Application Priority Data

Dec. 9, 2009 (DE) ..... 20 2009 016 729 U

(51) Int. Cl.
*F21V 7/04* (2006.01)

(52) U.S. Cl.
USPC ..... 362/97.2; 362/97.4; 362/605; 362/604; 362/609

(58) Field of Classification Search
USPC ..... 362/604, 605, 606, 609, 97.2
See application file for complete search history.

(56) References Cited

U.S. PATENT DOCUMENTS 5,570,951 A 11/1996 Bertling et al.
6,104,456 A * 8/2000 Davey ..... 349/71
7,153,017 B2 * 12/2006 Yamashita et al. ..... 362/606
7,633,581 B2 * 12/2009 Sikharulidze ..... 349/115
8,045,069 B2 * 10/2011 Ijzerman et al. ..... 349/15
2010/0135023 A1 6/2010 Heise

FOREIGN PATENT DOCUMENTS

DE 19910004 A1 9/2000
DE 4228895 C2 9/2002
DE 10135387 A1 2/2003
DE 10308703 A1 11/2004
DE 202007008430 U1 10/2008
DE 102008008484 A1 8/2009

* cited by examiner

*Primary Examiner* — Anabel Ton
(74) *Attorney, Agent, or Firm* — Alix, Yale & Ristas, LLP

(57) ABSTRACT

The invention relates to an illumination device, in particular in the form of a luminous emitter (14) for TV recordings, stages, etc. The luminous emitter (14) comprises a light source (29) and a plate-type element (25) arranged in the beam path of the light source (29). The plate-type element (25) comprises two transparent plates (26) with a layer of liquid crystals (22) arranged in between. The liquid crystals (22) are disordered in a first state. The liquid crystals (22) are aligned with one another in a second state. An electrical voltage is applied to the liquid crystal layer in order to change between the states. The invention enables a rapid change between direct illumination and diffuse illumination.

16 Claims, 6 Drawing Sheets

SPOTLIGHT WITH DIFFUSER

Figure 1:
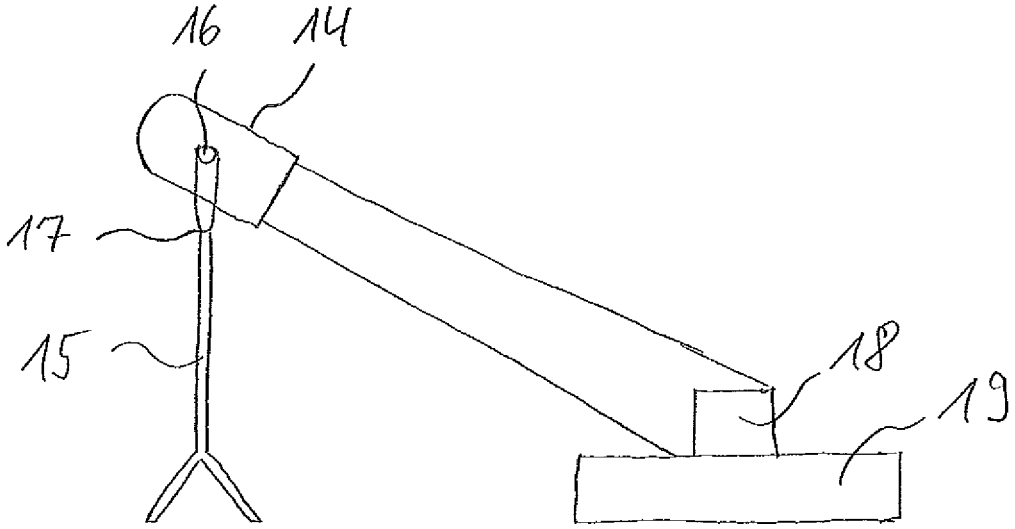

The invention relates to an illumination device, in particular in the form of a luminous emitter for TV studios, stages, etc. The illumination device comprises a light source.

Nowadays, stringent requirements are made of such luminous emitters. If one thinks of the use of object emitters in TV studios, for example, it is necessary for specific regions to be illuminated with high brightness, while other regions are intended to remain dark. Moreover, different properties of the emitted light are desirable depending on the type of TV recording desired. For a detail recording of a small portion of the stage, the light is intended to impinge on said portion in as concentrated a manner as possible. In the case of an overview recording of the stage overall, by contrast, an areal illumination is required.

According to a traditional procedure, powerful halogen emitters are used for such purposes, wherein the luminous region is restricted, if appropriate, by means of diaphragms or lens systems. For the change between concentrated illumination and areal illumination, use is made of diffusers which can optionally be introduced into the illumination beam path or be removed from the latter. Without a diffuser, the light from the object emitter impinges on a small portion of the stage in a concentrated manner. If the diffuser is introduced into the beam path, the light is scattered in a wide variety of directions, such that an areal illumination is produced. During the change between the two states, the diffuser is moved mechanically.

The invention is based on the object of presenting such an illumination device which enables rapid changes between different illumination states. Proceeding from the prior art mentioned in the introduction, the object is achieved by means of the features of the independent claim. Advantageous embodiments are found in the dependent claims.

According to the invention, a plate-type element is arranged in the beam path of the light source. The plate-type element comprises two transparent plates enclosing a liquid crystal layer between them. The plate-type element can assume two states. The liquid crystals are disordered in a first state. The liquid crystals are aligned with one another in a second state. An electrical voltage is applied to the liquid crystal layer in order to change between the states.

A luminous emitter denotes an illumination device of high light intensity which can be used to irradiate an object from a distance. The light emerging from the luminous emitter can be set in such a way that it is concentrated on the object, while other regions are not irradiated. Such object emitters can be used, in particular, in TV studios, theaters, stages. Uses in the illumination of buildings, display windows, display cabinets and the like are also possible.

The liquid crystals in the plate-type element have the property that they are light-transmissive in each case only in specific directions. If the liquid crystals in the liquid crystal layer are disordered, the light coming from the light source is scattered and directed in a wide variety of directions. Even if the liquid crystals are disordered, a large portion of the impinging light can pass through the plate-type element. The emerging light is diffuse, that is to say that the plate-type element acts in the manner of an opal glass pane. In the illumination device according to the invention, the plate-type element in this state acts as a diffuser.

If the liquid crystals in the liquid crystal layer are aligned with one another, the light emerging from the light source can pass directly through the plate-type element. In this state, the plate-type element is transparent in the sense that an object can be recognized through the plate-type element. In this state of the plate-type element, therefore, the light from the light source is directed directly onto the object. It is regularly the case that the liquid crystals are disordered in the initial state and they are aligned after a voltage has been applied. The plate-type elements thus have an electrically adjustable transparency. The plate-type elements as such are known and commercially available. The plate-type elements according to the invention should be distinguished from so-called light traps based on liquid crystals. What is characteristic of light traps such as are used in LCD displays, for example, is a state in which the light is not transmitted at all.

The diffuser according to the invention makes it possible to change over the illumination device between direct illumination and diffuse illumination virtually without any delay. In particular, it is no longer necessary to move the diffuser mechanically into the beam path or out of the latter.

The transparent plates of the plate-type elements are preferably arranged substantially parallel to one another. The plates can consist of glass or some other material, such as plastic, for example. The material can be rigid or flexible. If the plates are flexible, the plate-type element overall is also flexible. The plates can be planar. Embodiments in which the plates are curved are also possible.

The plate-type elements are often not very heat-resistant. If a light source is used which emits a large amount of heat, such as an incandescent lamp or a halogen lamp, for example, it is necessary to provide some distance between the diffuser and the light source in order that the diffuser is not damaged by the heat. A light source which emits only a small amount of heat, such as an LED, for example, is advantageous. The diffuser can then be arranged at a small distance from the light source, for example less than 20 cm, preferably less than 10 cm. The light source can comprise a plurality of LEDs. The LEDs can be arranged in a two-dimensional manner, for example in a matrix-type manner or in a honeycomb-like manner.

In order to further reduce the risk of heat damage, it is possible to provide cooling devices for the plate-type elements.

The LEDs preferably comprise a collimator optical unit arranged in front of the luminous substrate, such that the light is emitted in a narrow beam cone. The collimator optical unit of the LEDs should be distinguished from further lenses that the illumination device may have, if appropriate.

In order to subject the liquid crystals to an electrical voltage, an electrically conductive layer can respectively be formed on both sides of the liquid crystal layer. A voltage source can be provided between the two electrically conductive layers. In the simplest case, a switch is arranged between the voltage source and the electrically conductive layers, by means of which switch the voltage can be switched on or switched off. By actuating the switch, it is possible to change between a state of the plate-type element in which the liquid crystals are disordered, and a state in which the liquid crystals are aligned with one another. In one advantageous embodiment, a voltage regulator is provided, by means of which a multiplicity of different voltages can be applied between the electrically conductive layers. It is then possible to change between a completely disordered state and a completely aligned state of the liquid crystals in a plurality of steps or even continuously. For the diffuser, there is as a result the possibility of intermediate states between the wholly transparent state and the wholly diffuse state. The voltage regulator can be designed to set DC voltage or AC voltage, wherein the setting can preferably be effected in a continuously variable manner. The term voltage regulator also encompasses devices which generate different voltage profiles, for example by a specific average voltage being generated by rapid switching back and forth. Experiments have shown that rapidly changing voltages can bring about a faster reaction of the liquid crystals.

Occasionally it is desirable for a specific object to be permanently subject to direct illumination and for the illumination to be varied only in the surroundings of the object. It may therefore be expedient if the plate-type elements only partly mask the light emerging from the light source. It is then possible to set whether the permanent direct illumination is supplemented with further direct light or with diffuse light. One application for this could be the illumination of a display cabinet that is intended to be permanently directly irradiated, while different illuminations are desired in the surroundings, for example depending on the daylight additionally incident.

The illumination device according to the invention can be set up in such a way that even further properties of the light directed onto the object can be influenced. Said properties can be, for example, the color of the light or the color temperature. For this purpose, the light source can have a plurality of mutually separate light regions which emit light with different properties. If appropriate, the light regions can be produced by filters with different properties. By way of example, a first light region of the light source can emit warm-white light and a second light region of the light source can emit cold-white light. It is also possible for the different light regions to emit light in different colors. In order to be able to influence the properties of the light, the diffuser can comprise a plurality of mutually separate partial areas which can be driven separately from one another. The partial areas can be formed on an individual plate-type element or on a plurality of plate-type elements. The partial areas can be assigned to the light regions. Preferably, a partial area of the diffuser is arranged in front of each light region.

By separately driving the partial areas of the diffuser, it is then possible to influence the properties of the light. By way of example, if the partial area arranged in front of the warm-white light region is in the clear state (liquid crystals aligned) and the partial area arranged in front of the cold-white light region is in the diffuse state (liquid crystals disordered), then the object is primarily illuminated with warm-white light. If the object is then intended to be illuminated with cold-white light, opposite driving of the partial areas is necessary. If the voltage present at the partial areas is altered simultaneously and in opposite senses, then it is possible to change between warm-white light and cold-white light without the brightness changing significantly. Any desired intermediate states between warm-white light and cold-white light can also be set in this way. Corresponding transitions are possible between light of a different color.

Further optical effects can be achieved if the light emerging from the partial areas of the diffuser is subsequently superimposed concentrically. It thereby becomes possible, for example, to generate a white light beam from the light of a red, a green and a blue LED. If, in the case of one color, a changeover is made from direct illumination to diffuse illumination by changing the voltage at the plate-type element, a corona of the relevant color forms around the center, while the color in the center is present only with lower intensity. Such an effect is desirable in specific TV recordings. In one advantageous embodiment, the illumination device according to the invention therefore comprises an optical element which can be used to superimpose the light emerging from the partial areas.

The illumination device according to the invention can be equipped with further lens elements, which are arranged in the beam path and influence the illuminated region. Thus, the illumination angle or the illumination field can be varied and set to the actual requirement, see DE 20 2007 008 430 U1. The electrically drivable plate-type elements can be arranged directly downstream of the LEDs, that is to say between the LEDs and the lens systems. In another embodiment, having lenses or lens systems arranged successively in the beam path, the electrically drivable plate-type elements are arranged between the lenses or lens systems. Embodiments in which the plate-type elements are arranged beyond the lens system as seen from the light source are also possible.

Particularly in TV studios and on stages it is often required that the illumination can follow moving objects. For this purpose, it is possible to provide a suspension for the illumination device, which makes it possible that the illumination device can be moved relative to a rigid structure. By way of example, a stand is regarded as a rigid structure in this sense.

The invention furthermore relates to an arrangement comprising an illumination device according to the invention and a wall, wherein the illumination device is arranged in such a way that the light emerging from the illumination device impinges on the wall at an acute angle. This is the case, in particular, for walls which serve as a background in TV studios. Here an illumination device is arranged at a small distance from the plane of the wall and emits light obliquely onto the wall. For the TV recordings it is important that the region which can be seen in the recording is illuminated uniformly. The illumination device according to the invention makes it possible to vary between concentrated illumination of a small area and uniform illumination of a larger area. Moreover, the illumination device can be set in such a way that the different colors of a multicolored light source are not individually visible even in the close range.

At an acute angle is understood to mean, in particular, an angle of less than 20°, preferably less than 10°. The angle indication relates to the central beam of the illumination. The illumination device can be arranged on the same side of the wall on which the TV camera is also arranged. The light is then reflected from the wall. The application in the case of translucent walls is also possible. The illumination device is then arranged on the other side of the wall and the light passes through the wall.

Figure 2:
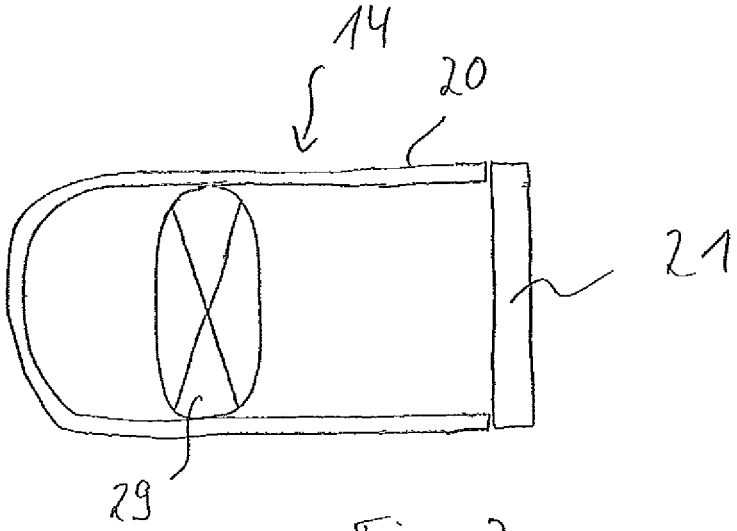
Figure 3:
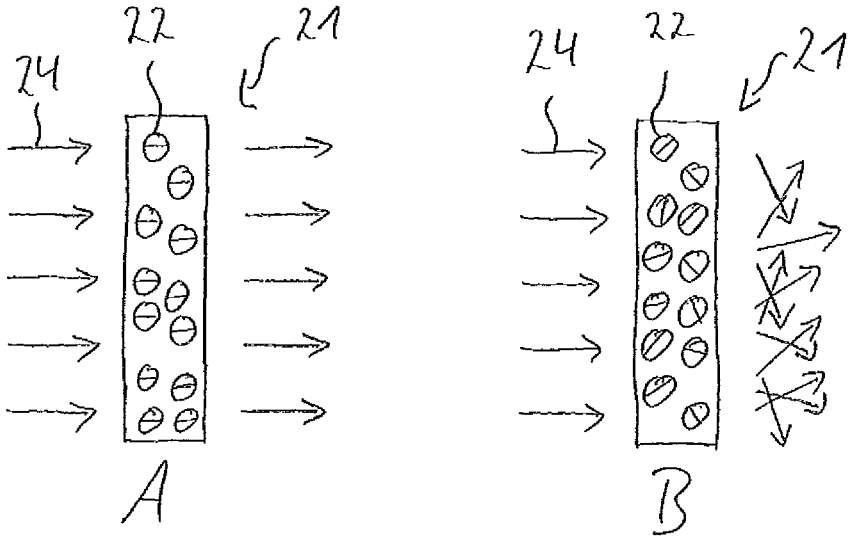
Figure 4:
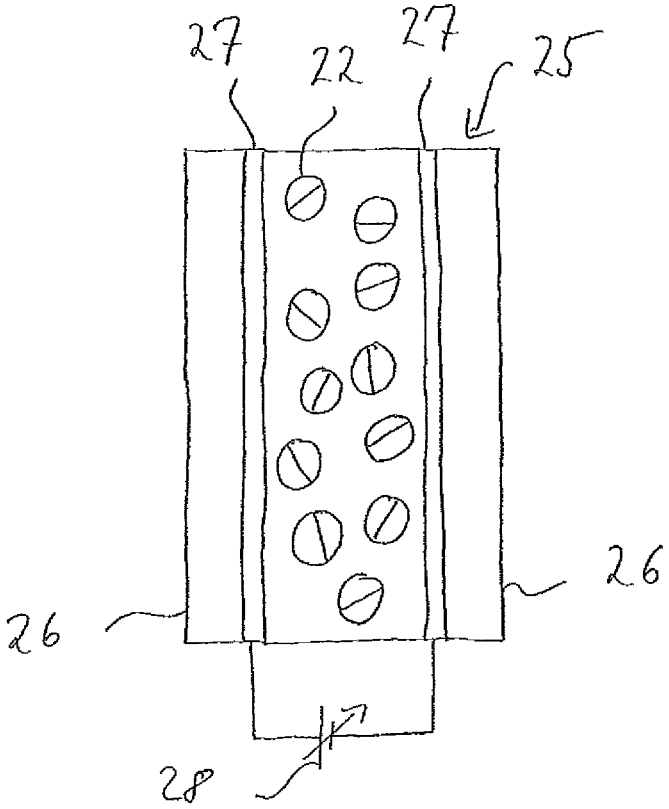
Figure 5:
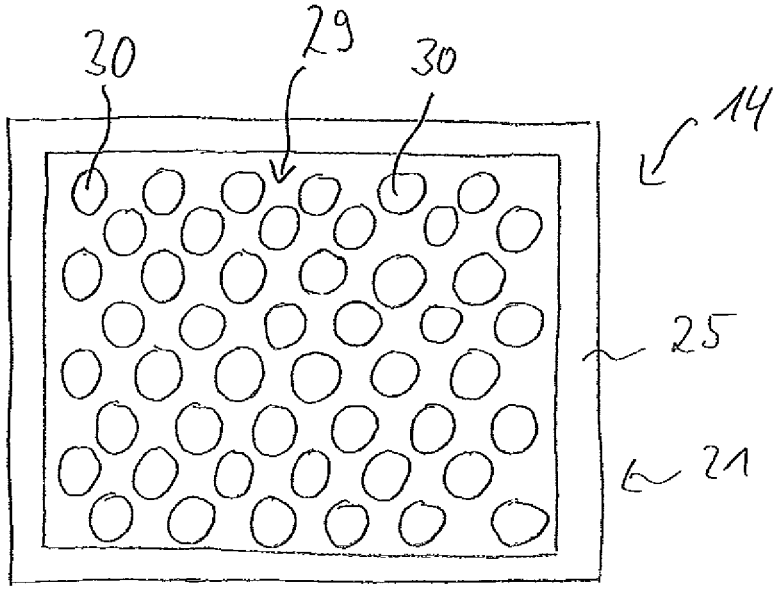
Figure 6:
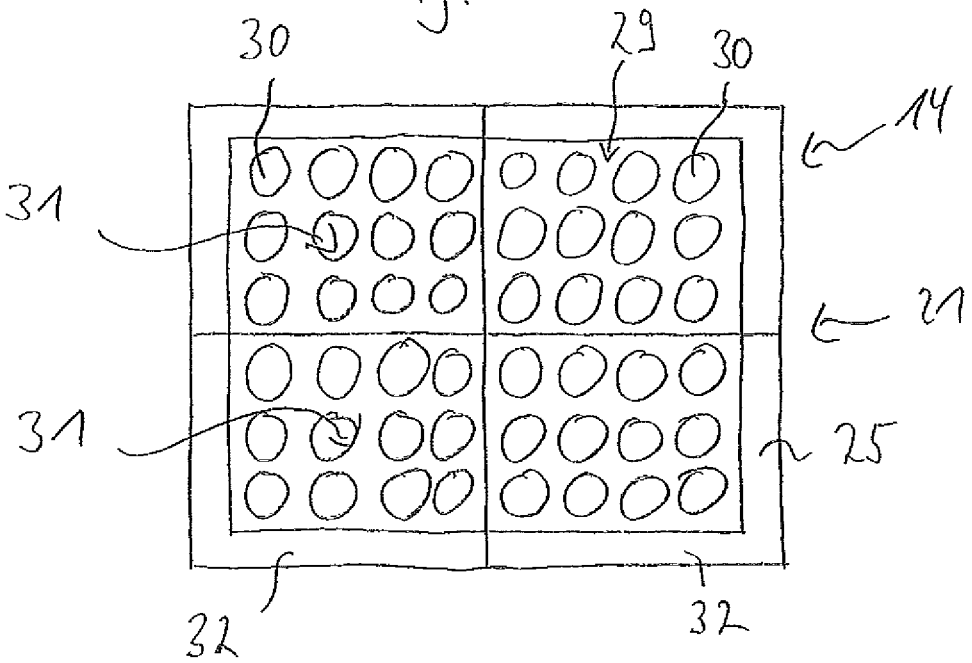
Figure 7:
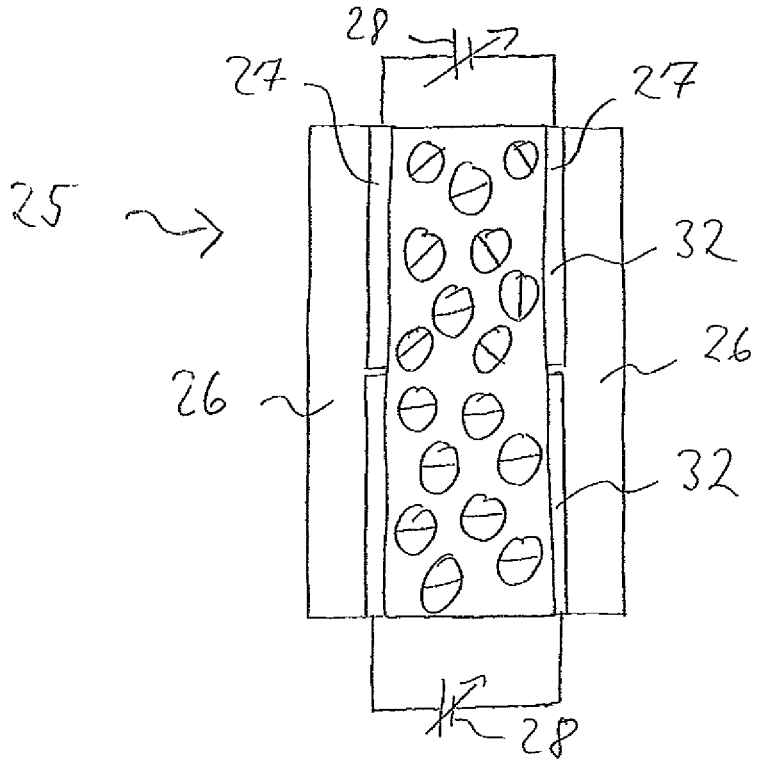
Figure 8:
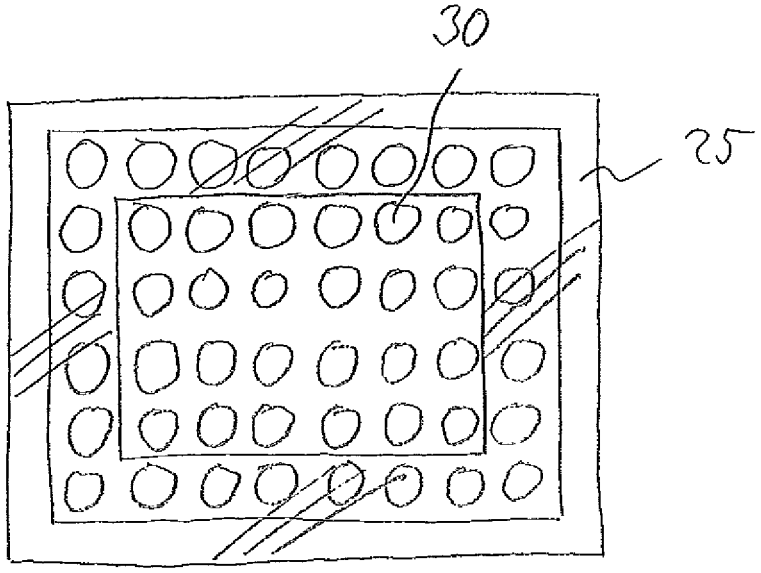
Figure 9:
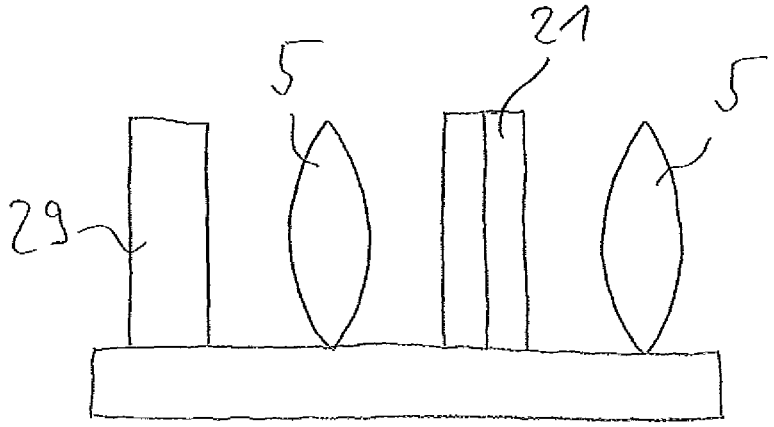
Figure 10:
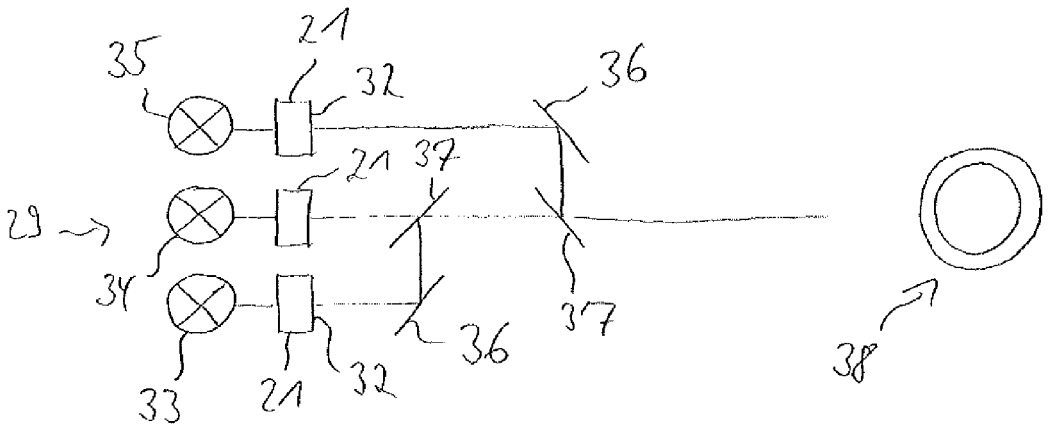

The invention is described by way of example below on the basis of advantageous embodiments with reference to the accompanying drawings, in which:

FIG. 1: shows an illumination device according to the invention in use;

FIG. 2: shows a schematic illustration of an illumination device according to the invention;

FIG. 3: shows a schematic illustration of the functioning of a diffuser;

FIG. 4: shows a schematic illustration of a diffuser;

FIG. 5: shows the illumination device from FIG. 2 in a view from the front;

FIG. 6: shows the view in accordance with FIG. 5 in the case of another embodiment of the invention;

FIG. 7: shows the view in accordance with FIG. 4 in the case of another embodiment of the invention;

FIG. 8: shows the view in accordance with FIG. 4 in the case of yet another embodiment of the invention;

FIG. 9: shows a schematic illustration of an alternative embodiment;

FIG. 10: shows a further embodiment of the invention; and

Figure 11:
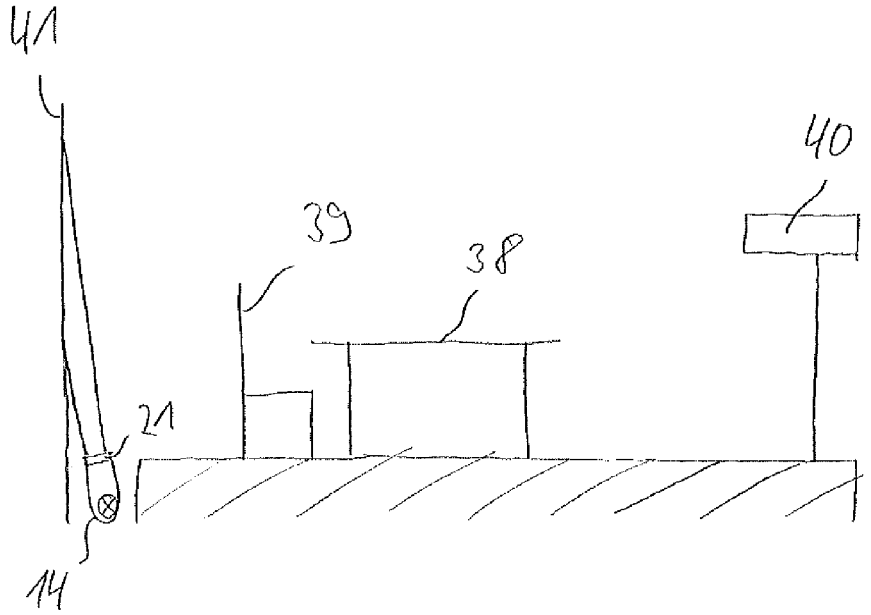

FIG. 11: shows an embodiment of an arrangement according to the invention.

An illumination device 14 according to the invention is arranged on a stand 15 in FIG. 1. By means of an articulation 16, the illumination device 14 can be pivoted upward and downward; by means of an articulation 17, the illumination device 14 can be rotated toward the right and left. In FIG. 1, the illumination device 14 is set in such a way that it supplies concentrated illumination for an object 18 on a stage 19.

In accordance with FIG. 2, the illumination device 14 comprises a light source 29 arranged in a housing 20. The light source 29 is composed of a plurality of LEDs 30, which are shown in FIG. 5. The LEDs 30 are arranged alongside one another in a honeycomb-like manner and are aligned parallel to one another with respect to the exit of the housing 20. Each LED 30 comprises a collimator optical unit, such that the light is emitted in the form of a narrowly delimited cone. A diffuser 21 is arranged at the exit of the housing 20. Embodiments in which the light source 29 is an individual powerful LED are also possible, for example with a power of more than 50 W.

The manner of operation of the diffuser 21 is explained below with reference to FIG. 3. The diffuser 21 contains a multiplicity of liquid crystals 22 which in each case transmit light only in specific directions. If the liquid crystals 22 are aligned with one another as in FIG. 3A, then they are all light-transmissive in the same direction. If light, indicated by arrows 24 in FIG. 3, impinges on the diffuser 22, the light can pass in the corresponding direction directly through the diffuser 22. The diffuser 22 is then transparent. If the liquid crystals 22 are disordered as in FIG. 3B, then the light is scattered in all possible directions in the diffuser 21. In this state, too, the majority of the light emerges again on the other side of the diffuser 21, but in a wide variety of directions. The effect of the diffuser 21 is similar to that of opal glass.

In accordance with FIG. 4, the diffuser in the illumination device 14 according to the invention has the form of a plate-type element 25. The plate-type element 25 comprises two glass plates 26 arranged at a small distance parallel to one another. The glass plates 26 enclose between them a layer comprising liquid crystals 22. A conductive layer 27 is in each case formed between the glass plates 26 and the liquid crystal layer. By means of a regulatable voltage source 28, a voltage can be applied between the conductive layers 27. If no voltage is present between the conductive layers 27, the liquid crystals 22 are disordered, and impinging light is scattered in a wide variety of directions. As a result of a voltage being applied between the conductive layers 27, the liquid crystals 22 are aligned with one another. Impinging light can pass straight through and the plate-type element 25 becomes transparent. The voltage source 28 is regulatable in a continuously variable manner, such that a continuously variable transition of the liquid crystals 22 from the disordered state to the state aligned with one another is possible.

In FIG. 1, a voltage is present at the diffuser 21 and the diffuser 21 is transparent. The light generated by the light source 29 passes straight through the diffuser 21 and impinges directly on the object 18 on the stage 19. This illumination state is suitable, for example, for making detail recordings of the object 18. If the voltage at the diffuser 21 is switched off, the liquid crystals 22 undergo transition to the disordered state, and impinging light is scattered in all directions. The stage 19 is uniformly illuminated with diffuse light over a large area, thus resulting in good illumination for overview recordings.

FIG. 6 shows a view from the front of an alternative embodiment of an illumination device 14 according to the invention. The light source 29 is subdivided into four mutually separate light regions 31. In each light region 31, twelve LEDs 30 are arranged in a matrix-type manner. Two light regions 31 lying obliquely opposite each other are equipped with LEDs 30 which emit cold-white light. The LEDs 30 of the other two light regions 31 emit warm-white light.

The plate-type element 25 of the diffuser 21 has four partial areas 32, to which a voltage can be applied independently of one another. A cross section through the corresponding plate-type element is shown in FIG. 7. The conductive layer 27 is interrupted in accordance with the partial areas 32. A voltage source 28 is provided for each partial area 32, such that independent driving of the partial areas 32 is possible. In FIG. 7, a voltage is present at the lower partial area 32 and is not present at the upper partial area 32.

Each of the partial areas 32 of the diffuser 21 is assigned to a light region 31 and positioned in front of the relevant light region 31. By applying a voltage to the partial areas 32, it is possible for the warm-white light and the cold-white light to be directly directed onto the object or scattered. By means of suitable driving of the partial areas 32, a continuous alteration of the color temperature of the illumination is thus possible. In particular, this change is possible without the brightness changing significantly at the same time.

If the light regions 31 are equipped with LEDs 30 of a different color, it is correspondingly possible to achieve conditions transitions in the color of the illumination. Instead of LEDs 30 having different colors, identically colored LEDs can also be used and the light can be influenced by corresponding filters.

In the case of the embodiment in FIG. 8, the plate-type element 25 covers only some of the LEDs 30. The centrally arranged LEDs 30 always emit directly onto the object. Only in the case of the LEDs 30 at the edge is it possible to set whether they are intended to directly illuminate the object or whether the light is intended to be scattered.

In the case of the embodiment in FIG. 9, two lens systems indicated schematically at 5 are provided, by means of which the illumination angle can be altered by said lens systems being displaced or parts of the lens systems being displaced relative to one another. By means of the plate 21 in this case it is again possible to choose between direct illumination by LEDs of the illumination device 1 and diffuse illumination.

In FIG. 10, the light source 29 is composed of a red LED 33, a green LED 34 and a blue LED 35, which are in each case equipped with a collimator optical unit. An individually drivable diffuser 21 is arranged in front of each LED. By means of mirrors 36 and the dichroic mirrors 37, the light is superimposed to form a concentric light beam. If all the diffusers 21 are in the same state, the superimposed light beam is white. If, by way of example, the light from the red LED 33 is scattered to a greater extent, then this results in an image such as is indicated at 38 in FIG. 10. A corona of red light forms, while the intensity of the red light is reduced in the center.

FIG. 11 shows a TV studio with a table 38 and a chair 39, on which a newsreader can sit, for example. The background for the images recorded by a TV camera 40 is formed by a wall 41. An illumination device 14 according to the invention is arranged at the foot of the wall and illuminates the wall 41 at an acute angle. By setting the diffuser 21, it is possible to set the intensity and the area distribution of the illumination in such a way that the desired image arises for the TV camera.

The invention claimed is:

1. An illumination device for TV recordings, stages, comprising a light source and a plate-type element arranged in the beam path of the light source, wherein the plate-type element has two transparent plates with a layer of liquid crystals arranged in between, wherein the liquid crystals are disordered in a first state which scatters light passing through said plate-type element, and wherein the liquid crystals are aligned with one another in a second state which allows light to pass directly through said plate-type element, and wherein an electrical voltage is applied to the liquid crystal layer in order to change between the states.

2. The illumination device as claimed in claim 1, wherein the light source has an LED.

3. The illumination device as claimed in claim 1, wherein the liquid crystals are enclosed between electrically conductive layers.

4. The illumination device as claimed in claim 3, wherein a regulatable voltage source is provided in order to apply a voltage between the electrically conductive layers.

5. The illumination device as claimed in claim 1, wherein the plate-type element only partly masks the light emerging from the light source.

6. The illumination device as claimed in claim 1, wherein the light source has a plurality of mutually separate light regions, and wherein the light regions emit light with different properties.

7. The illumination device as claimed in claim 1, wherein said illumination device has one or a plurality of plate-type elements having partial areas that are electrically drivable separately from one another.

8. The illumination device as claimed in claim 6, wherein the partial areas are assigned to the light regions.

9. The illumination device as claimed in claim 6, wherein an optical element is provided in order to superimpose the light emerging from different partial areas.

10. The illumination device as claimed in claim 1, wherein lens elements are provided in the beam path, by means of which lens elements the illumination zone can be altered.

11. The illumination device as claimed in claim 1, wherein it has cooling devices for the electrically drivable plate-type elements.

12. The illumination device as claimed in claim 1, wherein a suspension is provided, by means of which the illumination device can be moved relative to a rigid structure.

13. An arrangement comprising a wall and an illumination device, wherein the illumination device is embodied as claimed in claim 1 and is arranged in such a way that the light impinges on the wall at an acute angle.

14. The illumination device as claimed in claim 7, wherein the partial areas are assigned to the light regions.

15. The illumination device as claimed in claim 7, wherein an optical element is provided in order to superimpose the light emerging from different partial areas.

16. The illumination device as claimed in claim 8, wherein an optical element is provided in order to superimpose the light emerging from different partial areas.

* * * * *